US010975576B2

(12) United States Patent
Lebiedzinski et al.

(10) Patent No.: US 10,975,576 B2
(45) Date of Patent: Apr. 13, 2021

(54) STONE STRAP ASSEMBLY FOR INSTALLATION

(71) Applicant: Stone Selex Inc., Mississauga (CA)

(72) Inventors: Cezary Lebiedzinski, Belfountain (CA); Andrzej Powalowski, Mississauga (CA)

(73) Assignee: Stone Selex Inc., Mississauga (CA)

( * ) Notice: Subject to any disclaimer, the term of this patent is extended or adjusted under 35 U.S.C. 154(b) by 0 days.

(21) Appl. No.: 16/562,811

(22) Filed: Sep. 6, 2019

(65) Prior Publication Data

US 2020/0080319 A1 Mar. 12, 2020

Related U.S. Application Data

(60) Provisional application No. 62/727,756, filed on Sep. 6, 2018.

(51) Int. Cl.
*E04F 13/08* (2006.01)
*E04F 13/24* (2006.01)
*E04F 13/14* (2006.01)

(52) U.S. Cl.
CPC ..... *E04F 13/0835* (2013.01); *E04F 13/14* (2013.01); *E04F 13/24* (2013.01)

(58) Field of Classification Search
CPC ..... E04F 13/0835; E04F 13/24; E04F 13/14
See application file for complete search history.

(56) References Cited

U.S. PATENT DOCUMENTS 3,242,889 A * 3/1966 Thomas, Sr. ..... F23M 5/06 110/339
6,895,721 B2 * 5/2005 Watanabe ..... E04B 2/32 52/506.05
7,497,639 B2 * 3/2009 Lebot ..... E04F 13/0835 403/131
2007/0130860 A1 * 6/2007 Paquette ..... E04F 13/0835 52/311.1

FOREIGN PATENT DOCUMENTS

EP 3330453 A1 * 6/2018 ..... E04F 13/0851

* cited by examiner

*Primary Examiner* — Patrick J Maestri
(74) *Attorney, Agent, or Firm* — Emerson, Thomson & Bennett, LLC; Roger D. Emerson

(57) ABSTRACT

An assembly and method are provided for securing masonry or other product to a wall without mortar. The assembly comprises a masonry or other product having a front face, an opposed rear face, and a bore positioned in a central area of the rear face. The bore is dimensioned to releasably receive a fastener therein. The assembly further provides a bracket having an aperture for receiving the fastener therethrough, the bracket configured to be securable to the wall, the fastener securing the masonry product to the bracket when the fastener is directed through the aperture in the bracket and into the bore.

9 Claims, 7 Drawing Sheets

STONE STRAP ASSEMBLY FOR INSTALLATION

FIELD

The present invention relates to the field of mounting material onto or similar the interior or exterior wall or surface of a building, and more particularly, to the mounting of a stone product to a wall without the use of mortar.

BACKGROUND

A stone veneer is often used to clad the façade of a residential or commercial building, an interior wall, or a landscape wall. Both natural and manufactured stone veneers may be used for this purpose.

When attaching the stone veneer, a membrane is typically applied to the surface to be covered by the veneer to prevent water penetration. A wire mesh or lath is then laid over the membrane and secured to the surface. A layer of mortar (often referred to as a scratch coat) may then be spread over the wire mesh to provide a roughened surface to which the stones may be attached.

The stones are often affixed to this prepared surface by applying additional mortar or other bonding agent to the backside of the stone and "sticking" them onto the prepared surface. After the stones have been applied to the surface, grout may be inserted between the stones if desired.

The use of mortar and grout for this purpose, while effective, is often a messy and time-consuming endeavour. It may also be difficult perform, typically requiring professional assistance. As well, installation involving mortar and grout often cannot be performed during rain or cold weather, thus limiting the possible time in which the installation may be performed.

SUMMARY

In one aspect the invention there is provided an assembly for securing a masonry or other product to a wall or surface without mortar, the assembly comprising: a masonry or other product having a front face, an opposed rear face, and a bore positioned in a central area of the rear face, the bore dimensioned to releasably receive a fastener therein; and a bracket having an aperture for receiving the fastener therethrough, the bracket configured to be securable to the wall, the fastener securing the product to the bracket when the fastener is directed through the aperture in the bracket and into the bore.

In another aspect, there is provided a method for attaching a masonry or other product to a wall or surface without mortar, the method comprising: providing the product, having a front face, and an opposed rear face, with a bore positioned in a central area of the rear face; securing the product to a bracket by directing a fastener through an aperture in the bracket and into the bore in the product; and securing the bracket, and thereby the product, to the wall or surface.

BRIEF DESCRIPTION OF THE DRAWINGS

For a better understanding of the present invention, and to show more clearly how it may be carried into effect, reference will now be made, by way of example, to the accompanying drawings which show exemplary embodiments of the present invention in which.

DESCRIPTION

Figure 1:
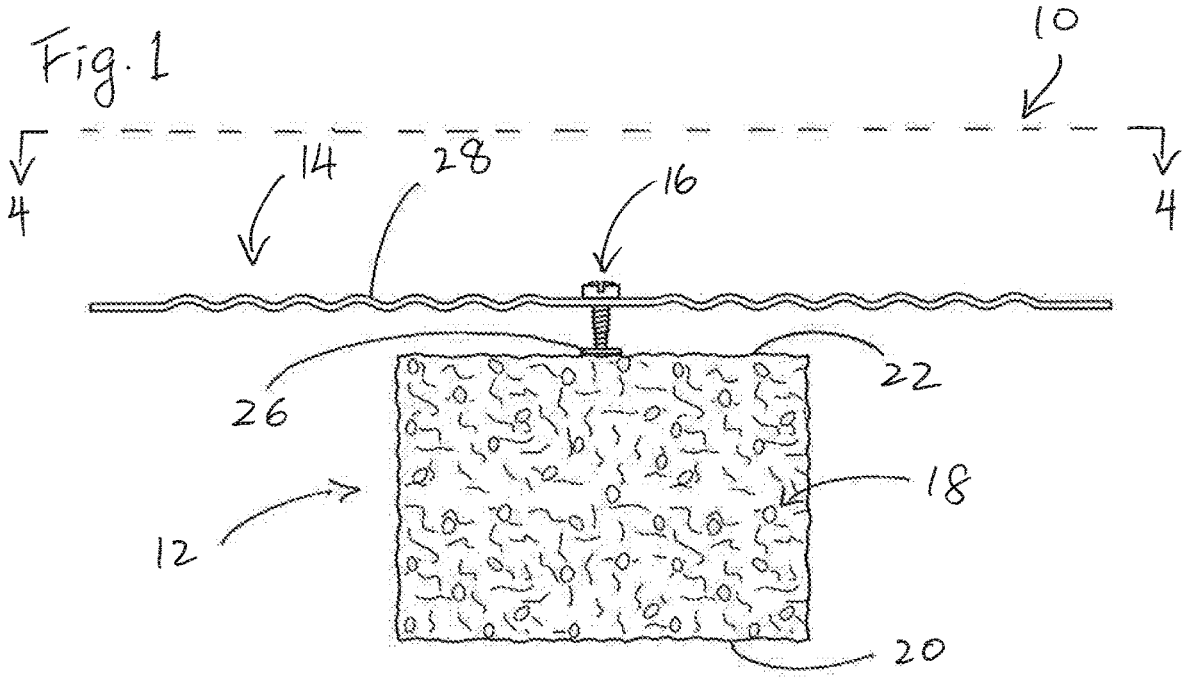
FIG. 1 is a side view of a first masonry product in an assembly in accordance with a first embodiment of the invention.
Figure 2:
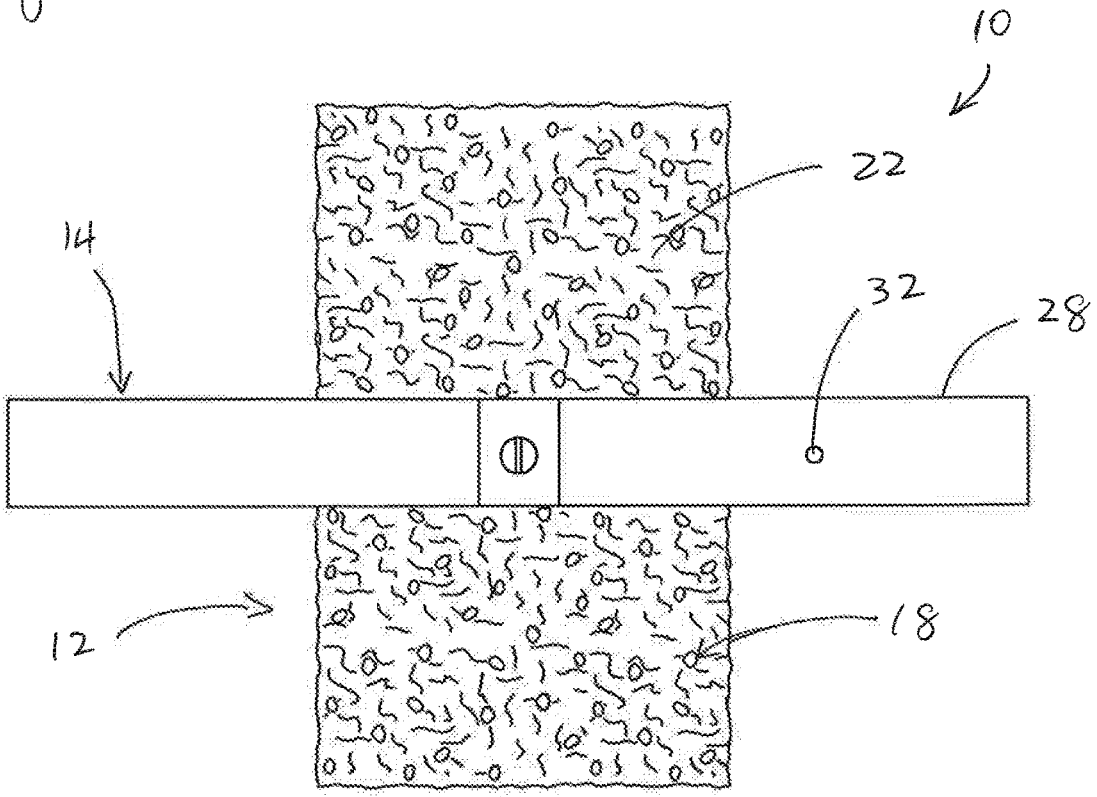
FIG. 2 is a rear view of the assembly of FIG. 1.
Figure 3:
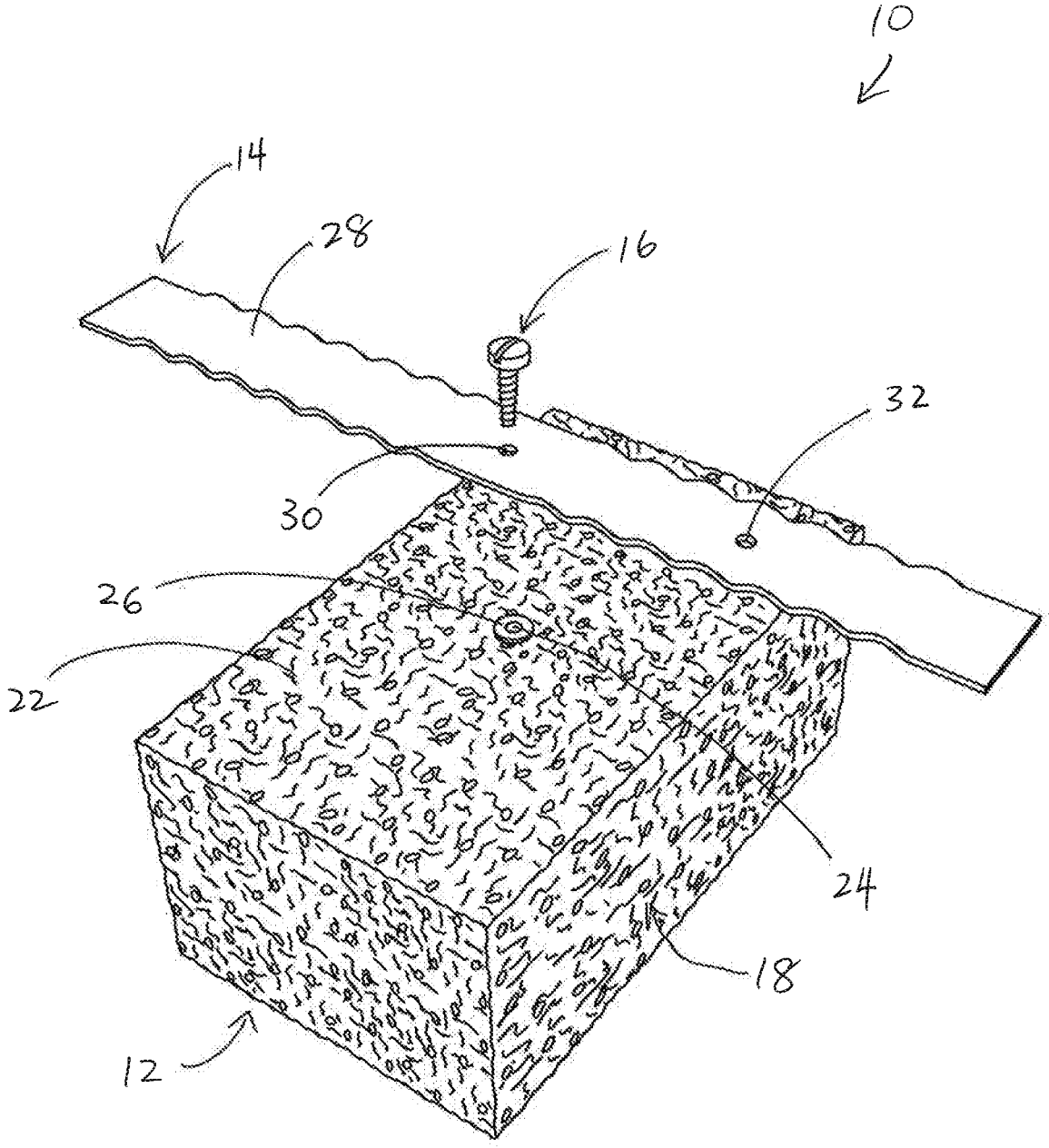
FIG. 3 is an exploded, upper perspective view of the assembly of FIG. 1.

The present invention may be embodied in a number of different forms. The specification and drawings that follow describe and disclose some of the specific forms of the invention.

The Figures illustrate a number of embodiments of an assembly 10 for securing masonry or other product to a wall without mortar. Assembly 10 generally includes a masonry product 12, a bracket 14 and a first fastener 16.

FIGS. 1-4 show a first embodiment of assembly 10. In this embodiment, masonry product 12 is a man-made stone or brick 18 with a front face 20, an opposed rear face 22 and a bore 24 positioned in a central area of rear face 22. Stone 18 may include an anchor 26, positioned within bore 24 for receiving first fastener 16 therein.

In the depicted embodiment, first fastener 16 is a standard screw that may be screwed through first aperture 30 and into anchor 26. In an alternate application, rather than using a standard screw and anchor 26, first fastener 16 may be secured directly within bore 24, for example, with a self-tapping screw, such as a Tapcon® concrete screw. In such a case, the Tapcon concrete screw may be screwed into a pre-drilled hole in man-made stone 18, rather than anchor 26. First fastener 16 may, optionally, be further secured in place through use of an adhesive.

As depicted, bracket 14 is typically a strap 28 which has a first aperture 30 for receiving first fastener 16 therethrough. Strap 28 is also configured to be securable to wall 100. In the present embodiment, to be securable to wall a 100, strap 28 includes a hole or second aperture 32 for receiving a fastener 34 therethrough.

When first fastener 16 is received through first aperture 30 and into anchor 26 (or directly into bore 24), bracket 14 is secured to stone 18. Stone 18 is in turn then securable to wall 100. For example, fastener 34 may be directed through second aperture 32 into wall 100 to hold assembly 10 in place. Other methods known in the art, by which bracket 14 may be secured to wall 100, may be used instead.

Figure 4:
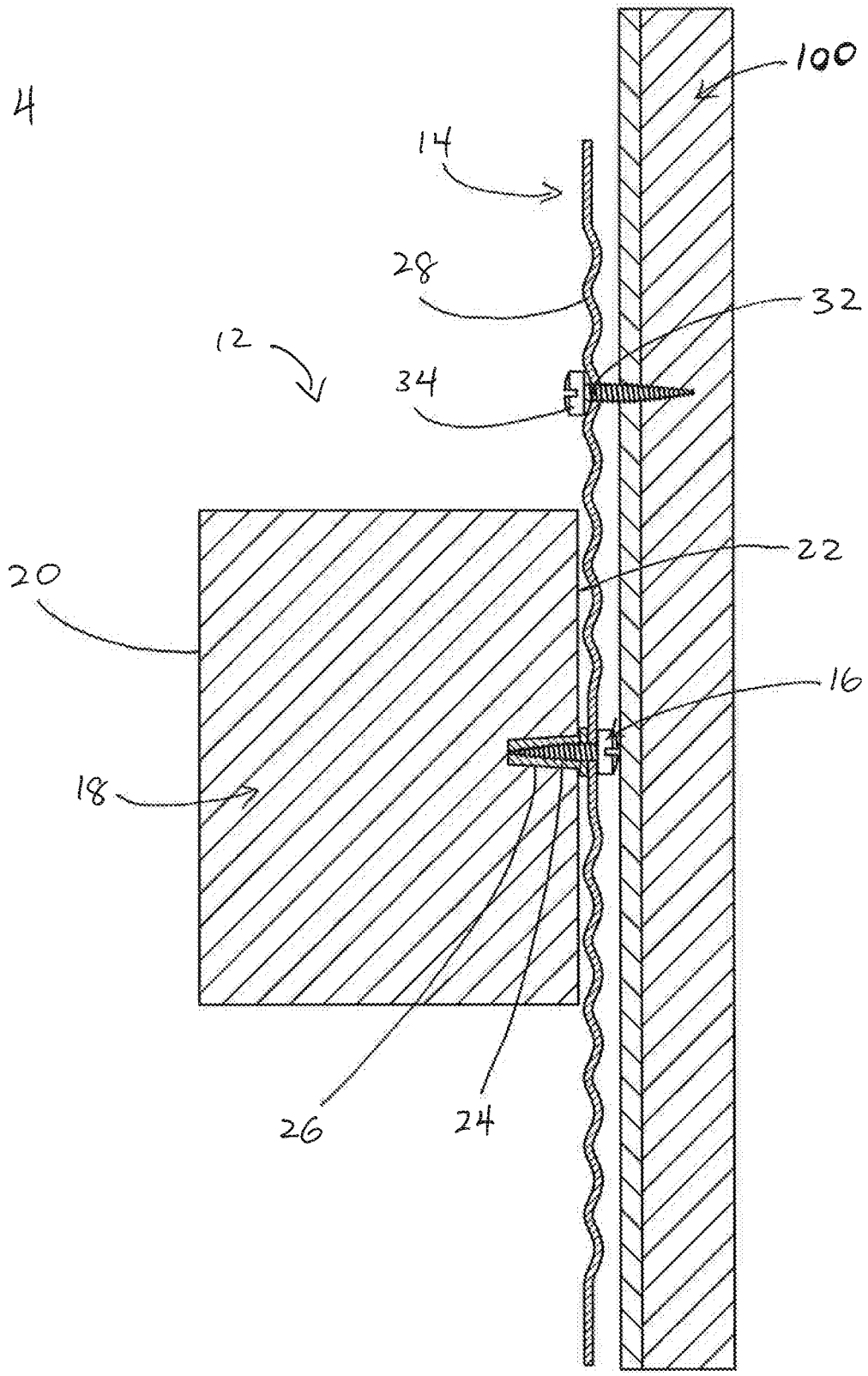
FIG. 4 is a cross-sectional view of the assembly of FIG. 1 taken along line 4-4 when the assembly is secured to a wall.

Strap 28 may have an irregular portion for maintaining rear face 22 of masonry product 12 at a predetermined distance from wall 100. For example, as shown in FIG. 4, strap 28 may be corrugated, to provide both additional structural rigidity to bracket 14 and to help maintain rear face 22 at a predetermined distance from wall 100 for water drainage purposes.

Assembly 10 may further include an adhesive (not shown) between bracket 14 and masonry product 12 to prevent rotation of masonry product 12 relative to bracket 14. Applying the adhesive between bracket 14 and wall 100 may also help to reinforce the masonry product's bond to the wall. The adhesive may be an industrial adhesive, such as PL Premium Construction adhesive by LePage®.

Figure 5:
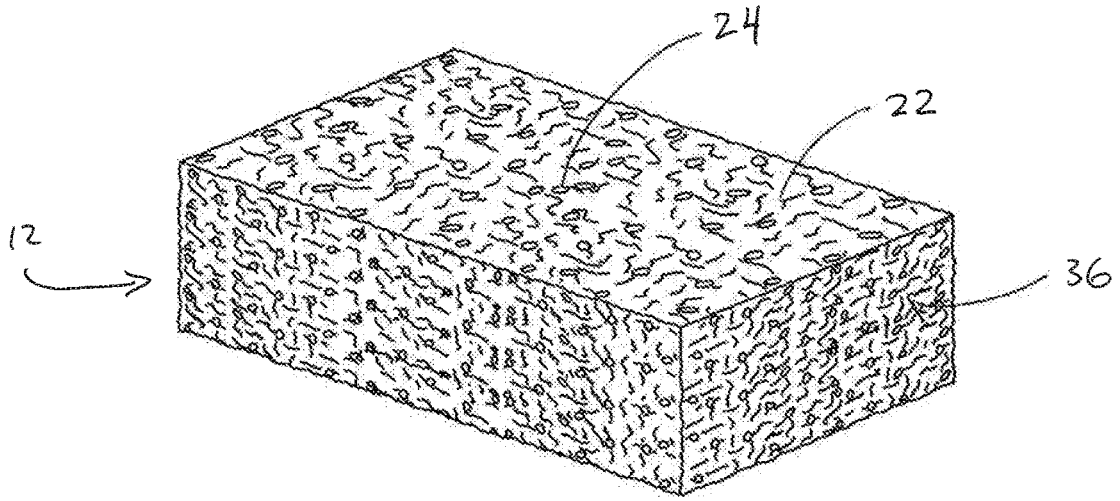
FIG. 5 is an upper perspective view of a second masonry product in isolation.
Figure 6:
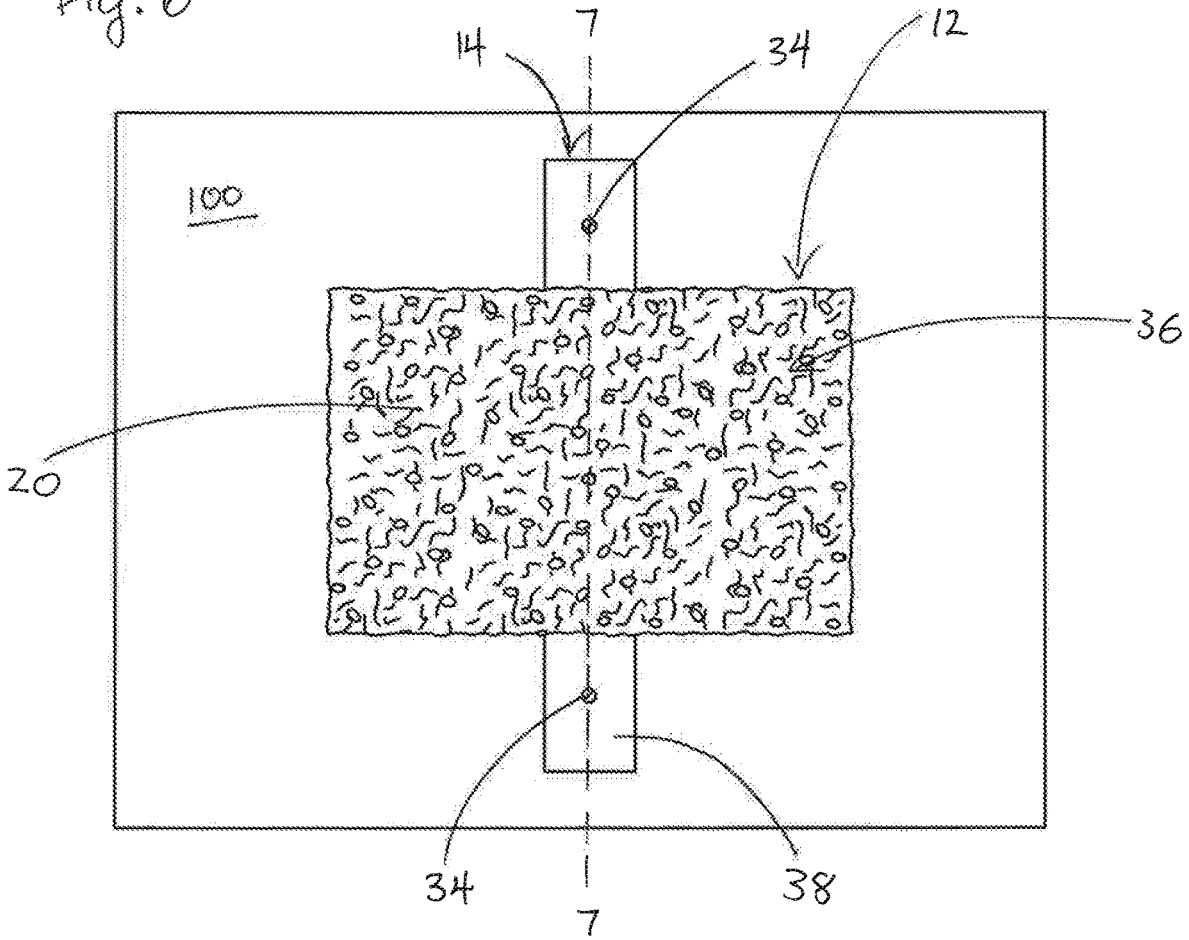
FIG. 6 is a front view of the second masonry product in an assembly, in accordance with a second embodiment of the invention, secured to a wall.
Figure 7:
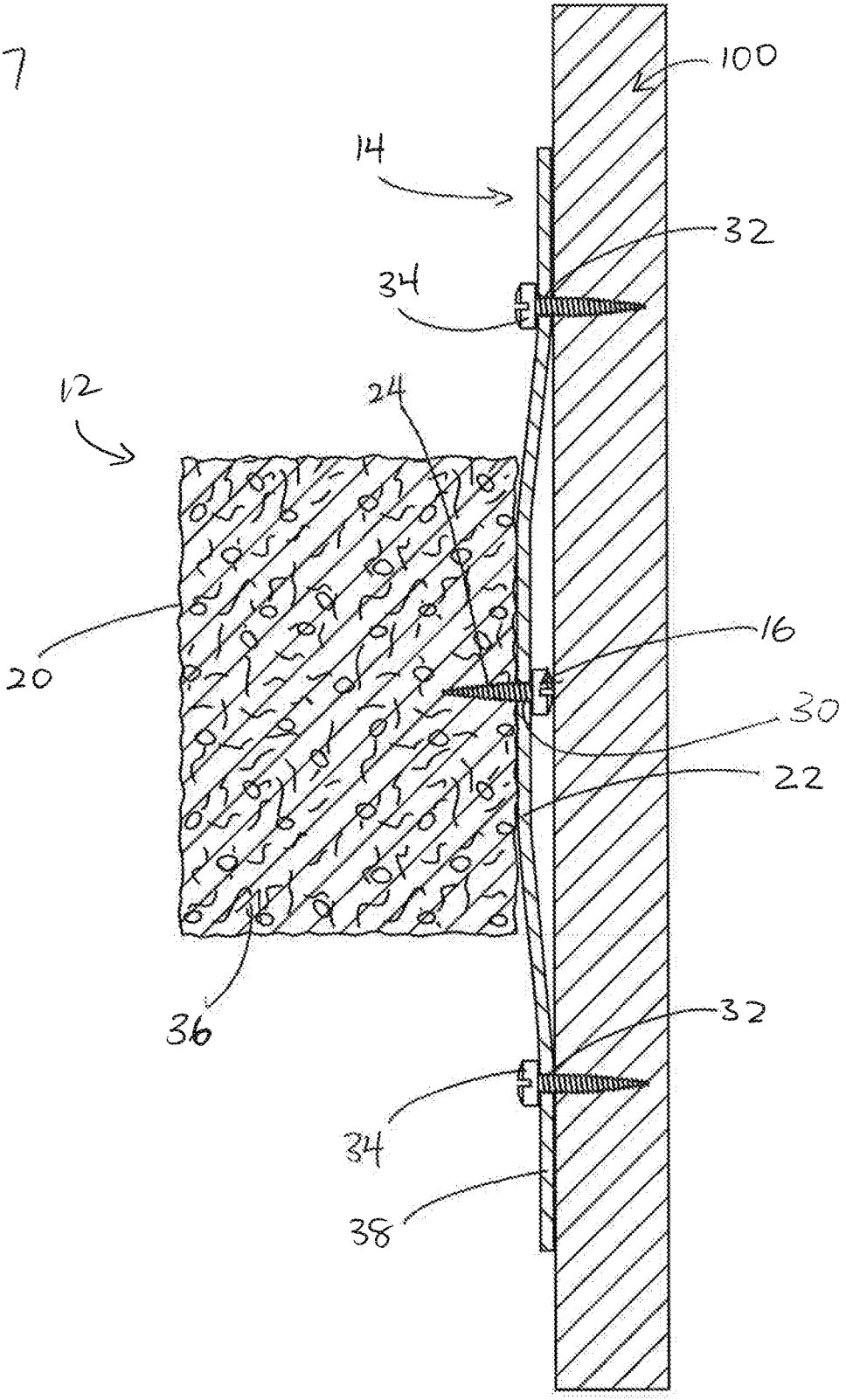
FIG. 7 is a cross-sectional view of the assembly of FIG. 6 along line 7-7.

FIGS. 5-7 show a second embodiment of assembly 10. In this embodiment, masonry product 12 is natural stone 36 with front face 20, opposed rear face 22 and bore 24 positioned in a central area of rear face 22. In this embodiment, assembly 10 is shown without anchor 26.

Bracket 14, as depicted herein, is a second strap 38 with first aperture 30 for receiving first fastener 16 therethrough. As there is no anchor in this embodiment, assembly 10 instead includes a wooden shim (not shown) wedged in bore 24 with first fastener 16 to secure first fastener 16 within bore 24.

Unlike strap 28 of the first embodiment, second strap 38 is generally smooth without an irregular or corrugated portion. In this manner, strap 38 may be securable to wall 100 through use of a pair of second apertures 32 for receiving second fasteners 34 therethrough. As understood by the skilled person, strap 38 may instead have a single aperture as in the first embodiment.

The second embodiment of assembly 10 may include an adhesive (not shown) between bracket 14 and masonry product 12 to prevent rotation of masonry product 12 relative to bracket 14. The second embodiment of assembly 10 may also include an adhesive between bracket 14 and wall 100 to help reinforce the masonry product's bond to the wall.

Figure 8:
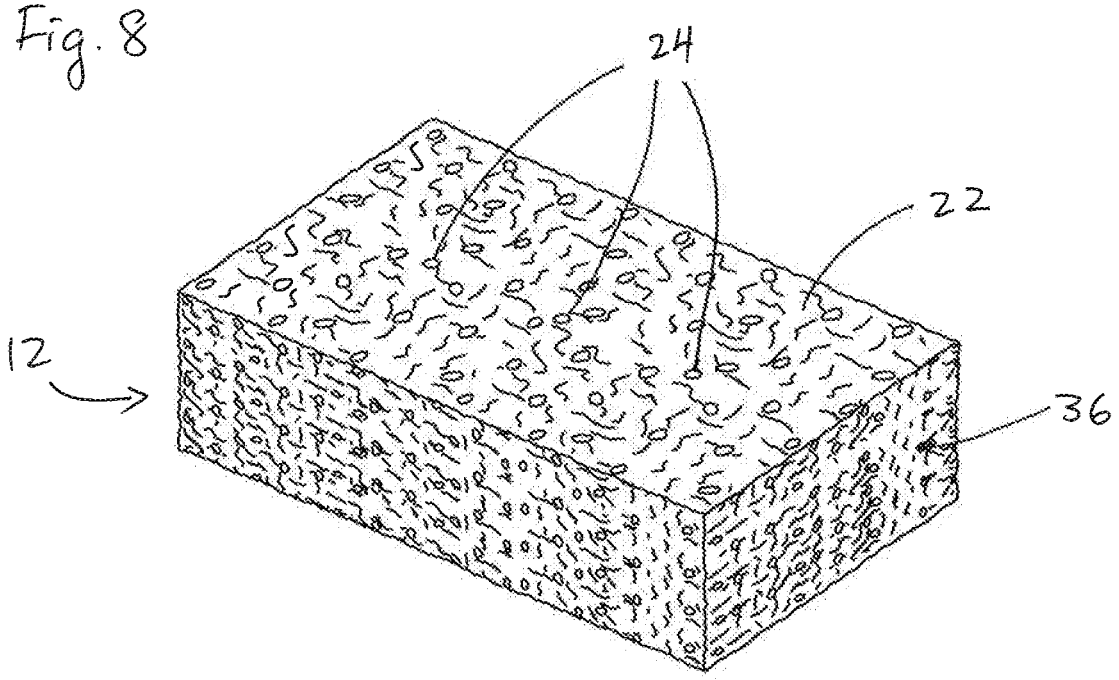
FIG. 8 is an upper perspective view of a third masonry product in isolation.
Figure 9:
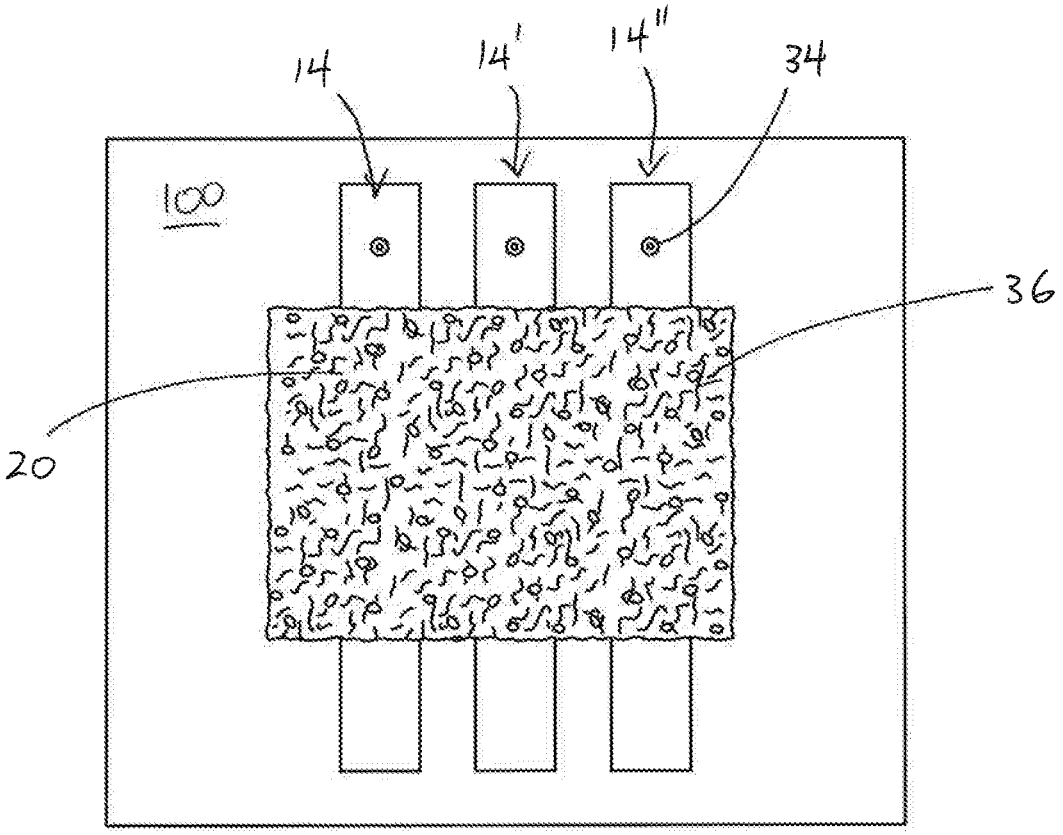
FIG. 9 is a front view of the third masonry product in an assembly, in accordance with a third embodiment of the invention, secured to a wall.
Figure 10:
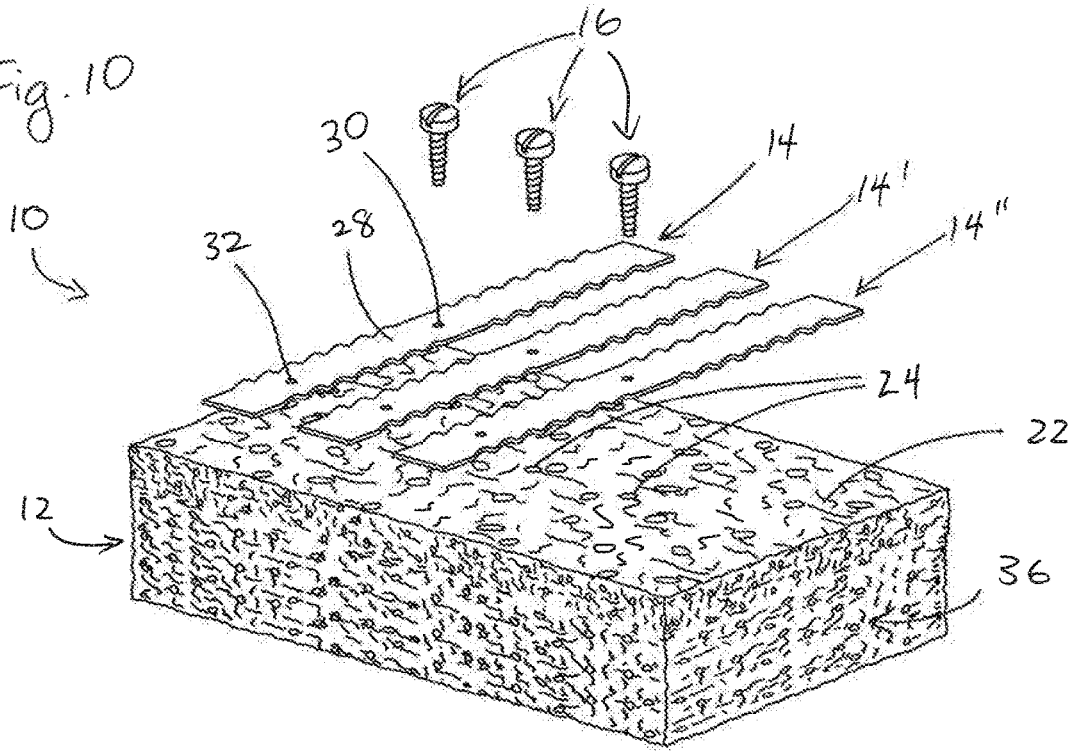
FIG. 10 is an exploded, upper perspective view of the assembly of FIG. 9.

FIGS. 8-10 show a third embodiment of assembly 10. In this embodiment, masonry product 12 is also natural stone 36 with front face 20 and opposed rear face 22. However, as depicted in FIG. 8, natural stone 36 of the third embodiment includes three bores 24 positioned in a central area of rear face 22. As shown in the second embodiment, the third embodiment of assembly 10 also does not include anchors.

This third embodiment of assembly 10 includes a second and third bracket 14', 14". Each of the brackets 14, 14', 14" are corrugated straps 28, each having a first aperture 30 for receiving a fastener 16 therethrough. First apertures 30 are positioned to correspond with bores 24 in masonry product 12.

In this embodiment, to be securable to wall 100, each bracket 14, 14', 14" includes a second aperture 32 for receiving a second fastener 34 therethrough.

In this manner, when first fasteners 16 are directed through first apertures 30 in brackets 14, 14', 14" and into bores 24, each fastener helps to secure masonry product 12 to its corresponding bracket 14, 14', 14". When second fasteners 34 are directed through each second aperture 32 into wall 100, the use of multiple second fasteners 34 help to prevent rotation of masonry product 12 relative to brackets 14, 14', 14" without use of an adhesive. Other manners known in the art by which brackets 14, 14', 14" may be secured to wall 100 may be used instead.

As will be understood by the skilled person, more than three or fewer than three brackets may be used in assembly 10.

Figure 11:
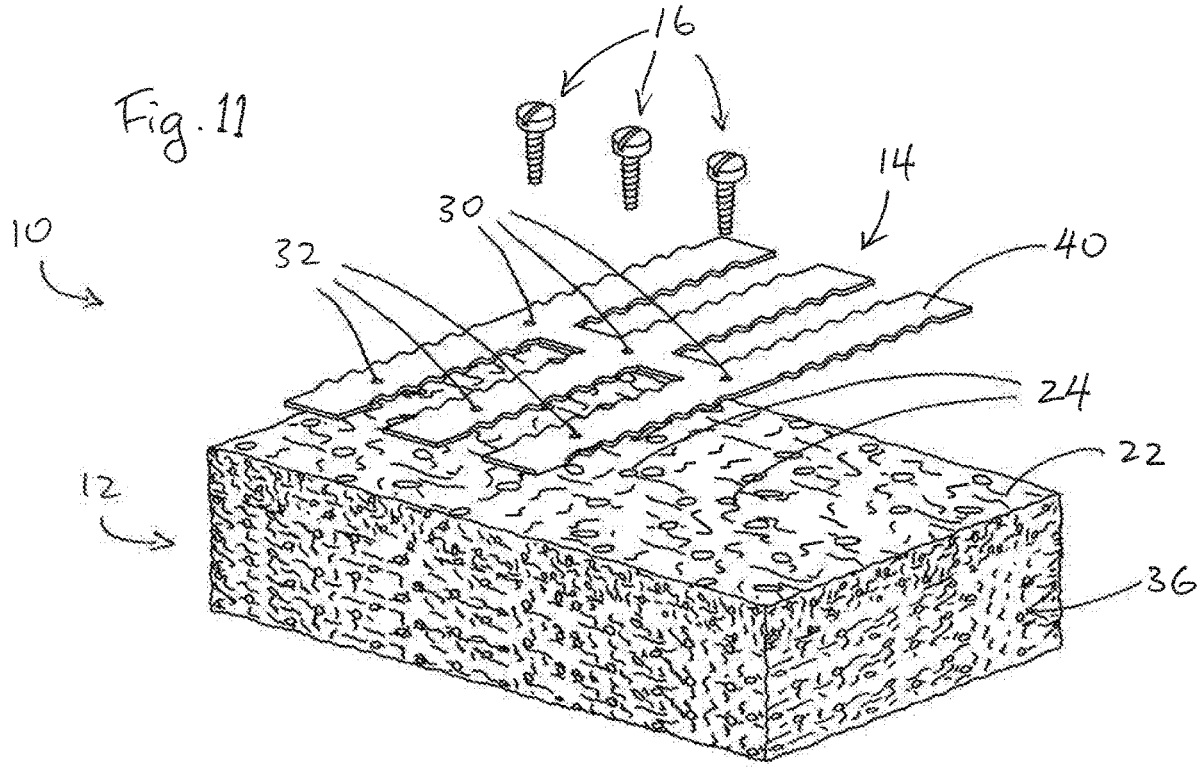
FIG. 11 is an exploded, upper perspective view of an assembly in accordance with a fourth embodiment of the invention.

FIG. 11 shows a fourth embodiment of assembly 10. In this embodiment, masonry product 12 is similar to that shown in the third embodiment (FIGS. 8-10) where masonry product 12 is also natural stone 36 with three bores 24 positioned in a central area of its rear face 22. Unlike the third embodiment, however, bracket 14 is a single H-shaped bracket 40 having three first apertures 30, each for receiving a first fastener 16 therethrough. First apertures 30 are positioned to correspond with bores 24 in masonry product 12. The use of multiple fasteners through a single bracket helps to prevent rotation of masonry product 12 relative to H-shaped bracket 40 without use of an adhesive.

In the fourth embodiment, to be securable to wall 100, H-shaped bracket 40 includes three second apertures 32, each for receiving a second fastener 34 therethrough. When second fasteners 34 are directed through second apertures 32 into the wall, the multiple second fasteners 34 help to prevent rotation of assembly 10 relative to wall 100 without use of an adhesive.

As will be understood by the skilled person, a bracket having greater or fewer than three first apertures 30 and/or second apertures 32 may be used instead. Alternatively, a bracket having a different geometry and/or a different irregular shaped portion may also be used, so long as first apertures 30 are generally positioned on bracket 14 to correspond with bores 24 in masonry product 12.

In another variation of the third and fourth embodiments (not shown in the Figures), masonry product 12 may have a second anchor and possibly a third anchor embedded within the central area, each respectively defining a second and a third bore. In such cases, the brackets would remain the same, where the bracket(s) have apertures positioned to correspond with the multiple bores. For example, three strap brackets 28 or H-shaped bracket 40 may be used.

Further, while masonry product 12 may have been specified to be man-made stone or natural stone in the above embodiments, masonry product 12 may either be man-made stone or natural stone in each of the embodiments noted above.

A method for attaching a masonry or other product 12 to a wall 100 without mortar according to an embodiment of the present invention is provided herein.

The masonry product, having a front face, an opposed rear face, and at least one bore positioned in a central area of the rear face, is provided. The bore may be drilled or cast into the masonry product, depending on the nature of the product.

Alternatively, an anchor may be embedded into the masonry product such that the anchor defines the bore for receiving a fastener. Where the masonry product is man-made, the embedding could involve setting the anchor or anchors in a viscous material prior to the material being cured into the masonry product.

The masonry product is then secured to the bracket. For example, a first fastener may be directed through a first aperture in a bracket into the bore in the masonry product.

Optionally, the method may also include applying an adhesive between the masonry product and the bracket to prevent rotation of the masonry product relative to the bracket.

The bracket, and thereby the masonry product, is then secured to the wall or surface. The bracket may be secured to the surface by directing a second fastener through a second aperture in the bracket into the wall. Other methods known in the art by which the bracket may be secured to the wall may instead be used. An adhesive may also be applied between the bracket and the wall to promote adhesion of the bracket to the wall.

Where the masonry product includes a second bore, the method may include directing an additional fastener through an additional aperture in the bracket into the second bore to prevent rotation of the masonry product relative to the bracket.

In alternate applications, where the masonry product again includes a second bore, the method may include directing an additional fastener through an aperture in a second bracket into the second bore to help prevent rotation of the masonry product relative to the brackets.

The method described may be repeated in order to cover the wall or surface with multiple assemblies. Masonry products 12 may be laid along a wall 100 and secured thereto starting at the bottom of the wall to complete a first row. When laying a subsequent row above the first row, the bottom part of the bracket of an assembly of the subsequent row may be tucked behind the row of stones underneath as each subsequent stone is placed. Brackets used in assembly 10 are typically made of galvanized steel, but they could also be made from a composite or synthetic material.

It is to be understood that what has been described are the preferred embodiments of the invention. The scope of the claims should not be limited by the preferred embodiments set forth above, but should be given the broadest interpretation consistent with the description as a whole.

We claim:

1. An assembly for securing a masonry product to a wall or surface without mortar, the assembly comprising:

a masonry product having a front face, an opposed rear face, and a bore positioned in a central area of the rear face, the bore dimensioned to releasably receive a first fastener therein; and a bracket having a first aperture for receiving the first fastener therethrough for securing the bracket to the masonry product, the bracket dimensioned to extend past the rear face of the product, the portion of the bracket extending past the rear face of the product having a second aperture therein for receiving a second fastener for securing the bracket to the wall, the first fastener securing the product to the bracket when the first fastener is directed through the first aperture in the bracket and into the bore wherein the bracket has a corrugated portion for maintaining the rear face of the product a predetermined distance from the wall.

2. The assembly of claim 1, wherein the product is natural stone.

3. The assembly of claim 1, further comprising a wooden shim or an anchor within the bore to aid in securing the first fastener within the bore.

4. The assembly of claim 3, further comprising an adhesive between the bracket and the product to prevent rotation of the product relative to the bracket.

5. The assembly of claim 3, wherein the product has a second bore in the central area of the rear surface, the bracket having a second aperture positioned to correspond with the second bore, the assembly further comprising a second fastener, wherein receipt of the second fastener through the second aperture into the second bore further secures the product to the bracket and prevents rotation of the product relative to the bracket.

6. The assembly of claim 3, wherein the product has a second bore in the central area of the rear surface, the assembly further comprising:

a second bracket configured to be securable to the wall, the second bracket having a second aperture, wherein receipt of a second fastener through the second aperture into the second bore further secures the product to the bracket and helps to prevent rotation of the product relative to the brackets when the brackets are secured to the wall or surface.

7. The assembly of claim 1, wherein the product is man-made stone or brick.

8. An assembly for securing a masonry product to a wall or surface without mortar, the assembly comprising:

a masonry product having a front face, an opposed rear face; and a pair of bores positioned in a central area of the rear face, each bore dimensioned to releasably receive a first fastener therein; and a bracket, in a shape of the letter H, having a pair of first apertures positioned therein to correspond with the pair of bores, each first aperture dimensioned to receive one of the first fasteners therethrough for securing the bracket to the masonry product, the bracket having two portions that extend past the rear face of the product, each of the portions of the bracket that extend past the rear face of the product having a second aperture therein for receiving a second fastener for securing the bracket to the wall, the first fasteners securing the product to the bracket when the first fasteners are directed through the first apertures in the bracket and into the bores.

9. A method for attaching a masonry product to a wall or surface without mortar using the assembly of claim 8, the method comprising:

securing the masonry product to the bracket by directing a pair of first fasteners through the corresponding pair of first apertures positioned in the bracket and into the pair of bores in the product; and securing the bracket, and thereby the masonry product, to the wall or surface by directing a pair of second fasteners through the second apertures in the two portions of the bracket that extend past the rear face of the product, and into the wall.

* * * * *